US008223095B2

(12) United States Patent
Kim

(10) Patent No.: US 8,223,095 B2
(45) Date of Patent: Jul. 17, 2012

(54) ORGANIC LIGHT-EMITTING DISPLAY DEVICE HAVING A PIXEL UNIT FOR TESTING PIXELS OF THE DISPLAY DEVICE

(75) Inventor: Eun-Ah Kim, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 731 days.

(21) Appl. No.: 11/506,828

(22) Filed: Aug. 21, 2006

(65) Prior Publication Data

US 2007/0075936 A1 Apr. 5, 2007

(30) Foreign Application Priority Data

Sep. 30, 2005 (KR) ..... 10-2005-0092145

(51) Int. Cl.
*G09G 3/32* (2006.01)

(52) U.S. Cl. ..... 345/82; 345/83; 345/84; 345/76; 345/211; 315/169.1; 315/169.3

(58) Field of Classification Search ..... 345/76, 345/55, 36, 45, 82–84, 90, 211; 315/169.3, 315/169.1, 167, 160, 168, 337, 334, 169.4
See application file for complete search history.

(56) References Cited

U.S. PATENT DOCUMENTS

2004/0263445 A1* 12/2004 Inukai et al. ..... 345/82

FOREIGN PATENT DOCUMENTS

| | | | |
|---|---|---|---|
| EP | 1 341 147 | A2 | 9/2003 |
| EP | 1 450 341 | A1 | 8/2004 |
| JP | 2003-150120 | | 5/2003 |
| JP | 2004-199054 | | 7/2004 |
| WO | WO2004/088626 | * | 10/2004 |
| WO | WO 2004/088626 | A1 | 10/2004 |
| WO | WO2004088626 | * | 10/2004 |
| WO | WO2004/097782 | * | 11/2004 |
| WO | WO 2004/097782 | A1 | 11/2004 |

OTHER PUBLICATIONS

Office Action issued in European Patent Application No. 06255080.1 on Feb. 20, 2007.
Office Action issued in Korean Patent Application No. 2005-92145 on Sep. 26, 2006.

* cited by examiner

*Primary Examiner* — Lun-Yi Lao
*Assistant Examiner* — Kelly B Hegarty
(74) *Attorney, Agent, or Firm* — Lee & Morse, P.C.

(57) ABSTRACT

An organic light-emitting display device having a pixel unit to test pixels, wherein the organic light-emitting display device includes: a substrate; a display unit located on the substrate; a plurality of first scan lines located in the display unit; and a second scan line located in the display unit and separated from the first scan lines, wherein a plurality of pixel units, except one test pixel unit located in at least one corner of the display unit, are electrically connected to the first scan lines, and the test pixel unit that is not connected to the first scan lines is electrically connected to the second scan line.

8 Claims, 4 Drawing Sheets

ORGANIC LIGHT-EMITTING DISPLAY DEVICE HAVING A PIXEL UNIT FOR TESTING PIXELS OF THE DISPLAY DEVICE

CROSS-REFERENCE TO RELATED PATENT APPLICATION

This application claims the benefit of Korean Patent Application No. 10-2005-92145, filed on Sep. 30, 2005, in the Korean Intellectual Property Office, the disclosure of which is incorporated herein in its entirety by reference.

BACKGROUND OF THE INVENTION

1. Field of the Invention

Aspects of the invention relate to an organic light-emitting display device, and more particularly, to an organic light-emitting display device having a pixel unit that has the same characteristics as the pixels of the display device and that is used for testing the pixels of the display device.

2. Description of the Related Art

An organic light emitting display device is an emissive display device that emits light by energy generated from exitons formed by recombining electrons and holes injected through an anode electrode and a cathode electrode in an organic thin film. The organic light emitting display device can operate at a low voltage, is thin and light, and has a wide viewing angle and a quick response time. Also, studies have been conducted with regard to active matrix (AM) organic light emitting display devices, where light emission or the absence of light emission and the degree of light emission of each pixel are controlled by a thin film transistor (TFT) included in each pixel.

In manufacturing organic light emitting display devices, tests for checking products, for example, the formation of pixels, the characteristics of a TFT in each pixel, etc., are typically necessary. In the conventional art, as depicted in FIG. 1, a pixel unit 50 to test the final product is further formed on a substrate 10 outside a display unit 20 to check the formation of pixels and the characteristics of the TFT in the pixel. The pixel unit 50 denotes a location where a pixel can be formed. The display unit 20 can include a display device that involves light emission or can include only an electronic device, such as a TFT that controls the display device.

As depicted in FIG. 2, after a test is completed using the pixel unit 50, the pixel unit 50 can be removed from a final light emitting display device by cutting along a line A-A, as necessary. However, where an additional pixel unit 50 to test pixels is formed, the surroundings and structure of the pixel in the pixel unit 50 can be different from pixels in the display unit 20. Therefore, the characteristics of the pixel in the pixel unit 50 and the pixels in the display unit 20 are not necessarily identical. Therefore, the reliability of a test result can typically be low.

SUMMARY OF THE INVENTION

Aspects of the invention provide an organic light emitting display device having a pixel unit that has the same characteristics as pixels displaying images and which is used for testing the pixels displaying the images.

According to an aspect of the present invention, there is provided an organic light-emitting display device, including: a substrate; a display unit located on the substrate; a plurality of first scan lines located in the display unit; and a second scan line located in the display unit and separated from the first scan lines, wherein a plurality of pixel units, except one pixel unit located in at least one corner, or other suitable area, of the display unit, are electrically connected to the first scan lines, and the pixel unit that is not connected to the first scan line is electrically connected to the second scan line.

According to aspects of the invention, the pixel unit electrically connected to the second scan line can be a pixel unit having the characteristics of the pixels displaying images of the display unit to test pixels of the display unit. The pixel unit electrically connected to the second scan line can include only electronic elements. The electronic elements can include thin film transistors (TFTs).

According to another aspect of the present invention, there is provided an organic light-emitting display device, including: a substrate; a display unit located in the substrate; a plurality of first data lines located in the display unit; and a second data line located on the display unit and separated from the first data lines, wherein a plurality of pixel units, except one pixel unit located in at least one corner, or other suitable area, of the display unit, are electrically connected to the first data lines, and the pixel unit that is not connected to the first data line is electrically connected to the second data line.

The pixel unit electrically connected to the second data line can be a pixel unit having the characteristics of the pixels displaying images of the display unit to test pixels of the display unit. The pixel unit electrically connected to the second data line can include only electronic elements. The electronic elements can be only thin film transistors (TFTs).

According to another aspect of the present invention, there is provided an organic light emitting display device, including: a substrate; a display unit located in the substrate; a plurality of first scan lines located in the display unit; and a second scan line located in the display unit and separated from the plurality of first scan lines; a plurality of first data lines located on the display unit; and a second data line located on the display unit and separated from the first data lines, wherein a plurality of pixel units, except one pixel unit located in at least one corner, or other suitable area, of the display unit, are electrically connected to the first scan lines and the first data lines, and the pixel unit that is not connected to the first scan lines and the first data lines is electrically connected to the second scan line and the second data line.

The pixel unit electrically connected to the second scan line and the second data line can be a pixel unit having the characteristics of the pixels displaying images of the display unit to test pixels of the display unit. The pixel unit electrically connected to the second scan line and the second data line can include electronic elements. The electronic elements can include thin film transistors (TFTs).

Additional aspects and/or advantages of the invention are set forth in the description which follows or are evident from the description, or can be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
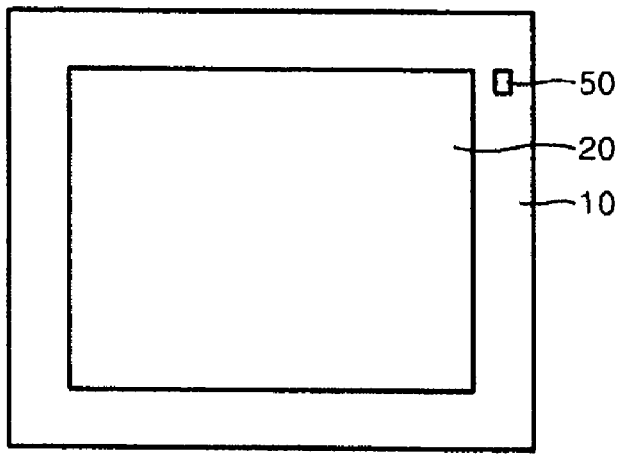
FIG. 1 (CONVENTIONAL ART)
FIG. 1 is a plan view of a conventional organic light emitting display device.
Figure 2:
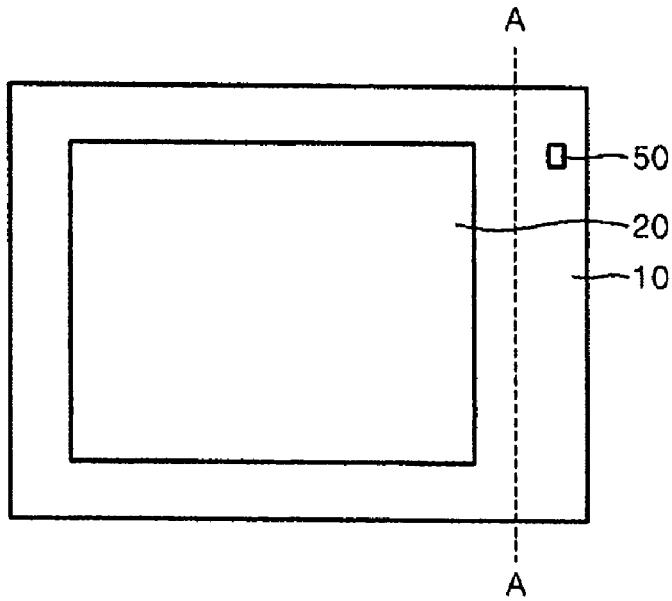
FIG. 2 (CONVENTIONAL ART)
FIG. 2 is a plan view of another conventional organic light emitting display device.

Reference will now be made in detail to embodiments of the invention, examples of which are illustrated in the accompanying drawings, wherein like reference numerals refer to the like elements throughout. The embodiments are described below in order to explain aspects of the invention by referring to the figures, with well-known functions or constructions not necessarily being described in detail.

Figure 3:
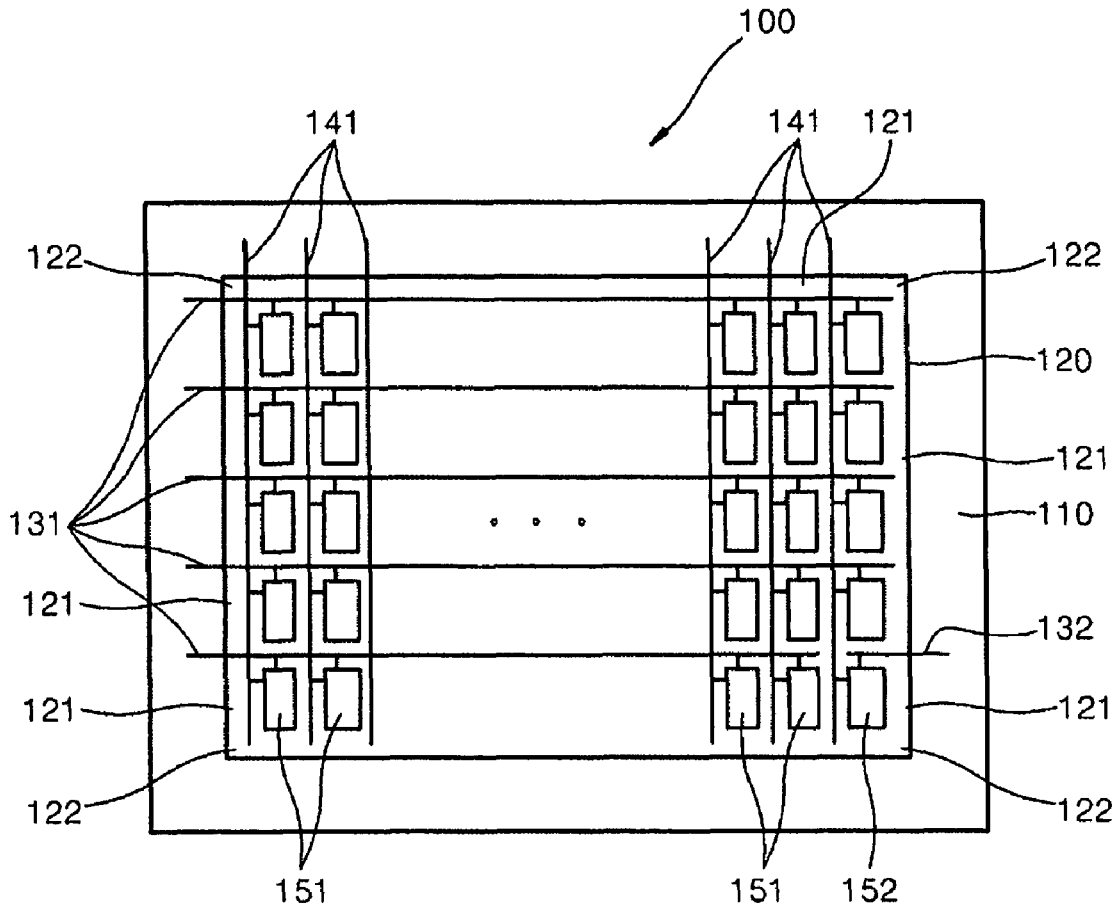
FIG. 3 is a plan view of an organic light emitting display device according to an embodiment of the invention.

FIG. 3 is a plan view of an organic light emitting display device 100 according to an embodiment of the invention. Referring to FIG. 3, a display unit 120 is formed on a substrate 110. The display unit 120 includes a plurality of pixel units 151 and 152. The pixel units 151 and 152 in FIG. 3 denote sub-pixel units. Therefore, hereinafter, each of the pixel units 151 and 152 can denote a set of a minimum number of sub-pixels of red, green, and blue color to generate white light or can denote each of the sub-pixels.

The pixel units 151 and 152 denote locations where pixels can be formed, and can include an organic light-emitting device that involves light emission. The substrate 110 can be a glass substrate, a plastic substrate formed of various plastics such as acryl, etc., or a metal substrate, or other suitable substrate, and the substrate 110 according to aspects of the invention is therefore not limited in this regard.

The display unit 120 includes a plurality of first scan lines 131 and at least one second scan line 132 separated from the first scan lines 131. All pixel units 151, except for the at least one pixel unit 152 located on at least one corner 122, or other suitable area, such as in a peripheral area 121 which includes the corners 122, of the display unit 120, are electrically connected to the first scan lines 131, and the pixel unit 152, which is not electrically connected to the first scan lines 131 is electrically connected to the second scan line 132. In FIG. 3, at least one pixel unit 152 located in a lower right corner 122 of the display unit 120 is connected to the second scan line 132. Of course, various connection modifications are possible with regard to connecting the pixel units 151 and the at least one pixel unit 152. For example, a plurality of pixel units located in the lower right corner 122 of the display unit 120 can be connected to the second scan line 132, or pixel units located in another corner 122 of the display unit 120 can also be connected to the second scan line 132. Also, according to aspects of the invention, various connection modifications are also possible for the pixel units 151 and the at least one pixel unit 152 of the organic light emitting display device 100 of FIG. 3, the organic light emitting display device 101 of FIG. 4 and the organic light emitting display device 102 of FIG. 5, or for other embodiments of the invention.

In the organic light emitting display device 100 of FIG. 3, a plurality of data lines 141 crossing the first scan lines 131 is formed. The pixel units 151 and the pixel unit 152 are electrically connected to the data lines 141. The pixel units 151 electrically connected to the first scan lines 131 and the pixel unit 152 electrically connected to the second scan line 132 are organic light emitting elements including a first electrode, a second electrode facing the first electrode, and an intermediate layer interposed between the first electrode and the second electrode and formed of an organic material. The intermediate layer can be formed of multiple layers including at least a light-emitting layer.

The configuration of the organic light-emitting elements, such as the pixel units 151 and the pixel unit 152, will now be described. The first electrode of the organic light-emitting elements functions as an anode electrode, and the second electrode of the organic light-emitting elements functions as a cathode electrode. The polarity of the first electrode and the second electrode of the organic light-emitting elements can be opposite to each other.

The first electrode of the organic light-emitting elements can be a transparent electrode or a reflection electrode. When the first electrode of the organic light-emitting elements is a transparent electrode, the first electrode can be formed of ITO, IZO, ZnO or $In_2O_3$, and where the first electrode of the organic light-emitting elements is a reflection electrode, after a reflection film is formed using Ag, Mg, Al, Pt, Pd, Au, Ni, Nd, Ir, Cr, or a compound of these metals, a film can be formed on the reflection film using ITO, IZO, ZnO or $In_2O_3$.

The second electrode of the organic light-emitting elements can also be a transparent electrode or a reflection electrode. When the second electrode of the organic light-emitting elements is a transparent electrode, after depositing a material layer formed of Li, Ca, LiF/Ca, LiF/Al, Al, Ag, Mg, or a compound of these metals facing the organic film layer interposed between the first electrode and the second electrode of the organic light-emitting elements, an auxiliary electrode or a bus electrode line can be formed using a material for forming the transparent electrode, such as ITO, IZO, ZnO or $Zn_2O_3$, on the material layer. Where the second electrode of the organic light-emitting elements is a reflection electrode, the second electrode of the organic light-emitting elements is formed by entirely depositing Li, Ca, LiF/Ca, LiF/Al, Al, Ag, Mg, or a compound of these metals.

The intermediate layer of the organic light-emitting elements includes at least an emission layer formed between the first electrode and the second electrode of the organic light-emitting elements. The intermediate layer of the organic light-emitting elements can be formed of a low molecular organic material or a polymer organic material.

Where the intermediate layer of the organic light-emitting elements is formed of a low molecular weight organic material, the intermediate layer of the organic light-emitting elements can be formed in a single or a composite structure by stacking a hole injection layer (HIL), a hole transport layer (HTL), an emission layer (EML), an electron transport layer (ETL), and an electron injection layer (EIL). Organic materials that can be used to form the organic intermediate layer of the organic light-emitting elements can include copper phthalocyanine (CuPc), N,N'-Di(naphthalene-1-yl)-N,N'-diphenyl-benzidine (NPB), and tris-8-hydroxyquinoline aluminium (Alq3). The structure of the intermediate layer of the organic light-emitting elements and the materials to form the intermediate layer of the organic light-emitting elements, according to aspects of the invention, are not limited in this regard. The organic intermediate layer of the organic light-emitting elements can be formed using a vacuum evaporation method using masks, for example.

When the intermediate layer of the organic light-emitting elements is formed of a polymer organic material, the intermediate layer of the organic light-emitting elements can include a hole transport layer (HTL) and an emission layer (EML). The polymer hole transport layer (HTL) can be formed of poly-(2,4)-ethylene-dihydroxy thiophene (PEDOT) and the polymer organic light emitting layer can be formed of poly-phenylenevinylene (PPV) group or polyfluorene group polymer, for example.

Also, in the organic light emitting display device 100 of FIG. 3, the organic light-emitting elements, such as the pixel units 151 and the pixel unit 152, formed on the substrate 110 can be sealed by a facing member. The facing member can be formed of glass or plastic similar to the substrate 110, or other suitable material or composition. The facing member can also be a metal cap, or other suitable cap.

Figure 4:
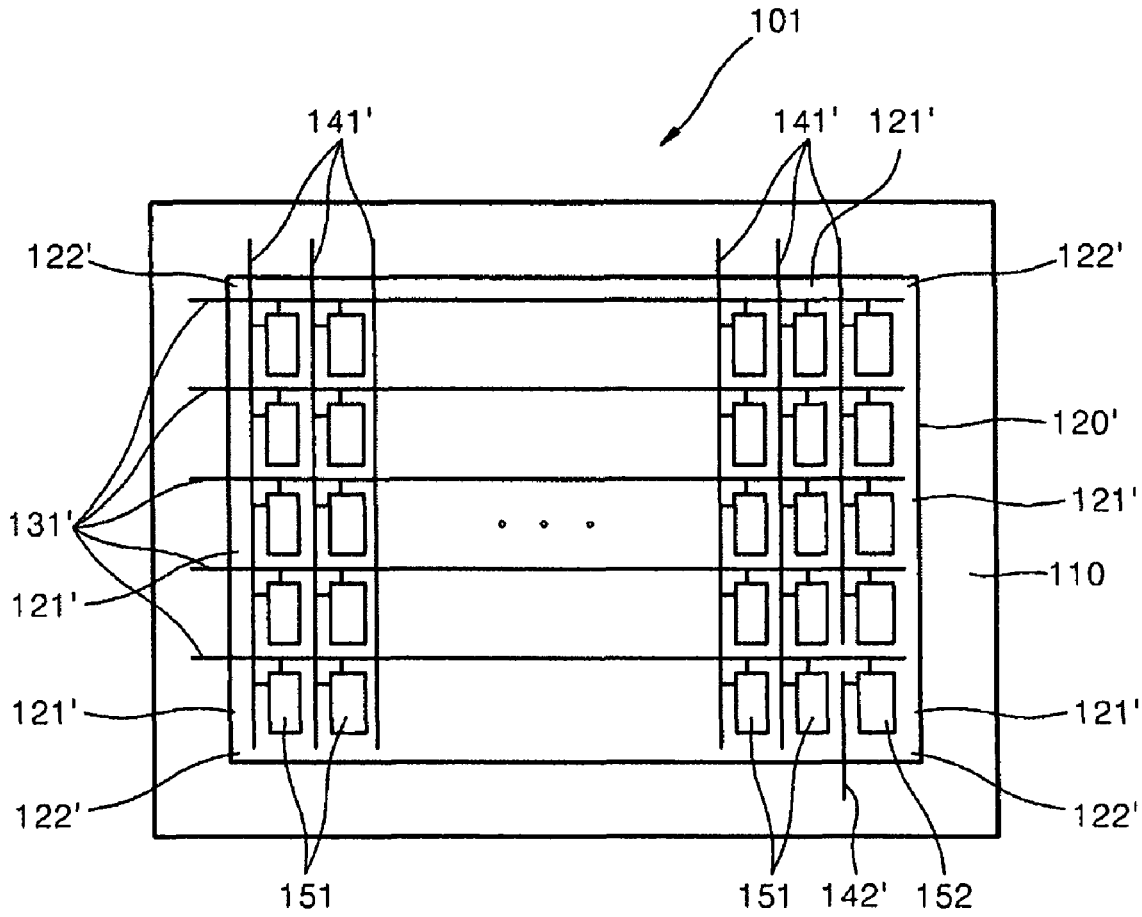
FIG. 4 is a plan view of an organic light emitting display device according to another embodiment of the invention.
Figure 5:
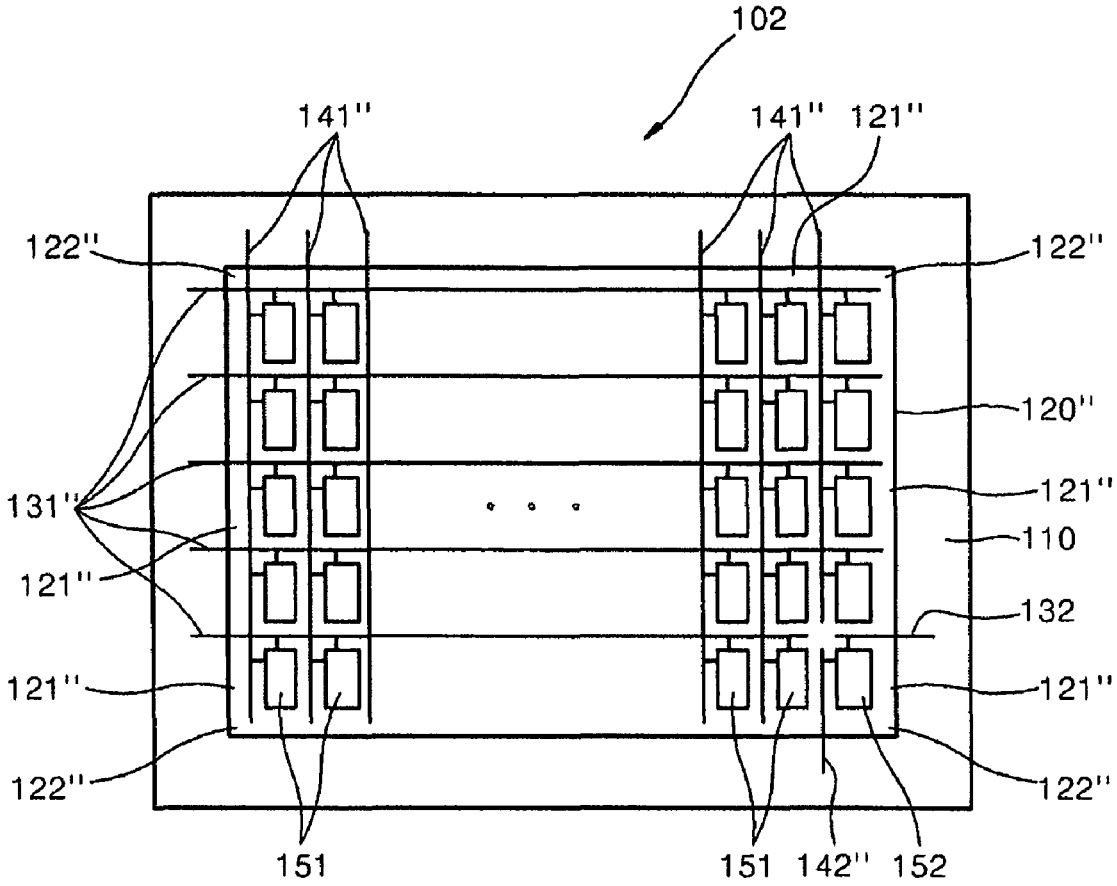
FIG. 5 is a plan view of an organic light emitting display device according to another embodiment of the invention.

Further, according to aspects of the invention, the exemplary above described structure and composition of the organic light emitting elements in the organic light emitting display 100 of FIG. 3, including the first electrode, the second electrode the intermediate layer, the facing layer and the cap, can also apply to the structure and composition of the organic light emitting elements, such as the pixel units 151 and the at least one pixel unit 152, of the organic light emitting display device 101 of FIG. 4 and the organic light emitting display device 102 of FIG. 5, or to other embodiments of the invention.

In the organic light emitting display device 100 of FIG. 3, the pixel unit 152 located in a lower right corner 122 of the display unit 120 and electrically connected to the second scan line 132 is a pixel unit to testing pixels. Therefore, the pixel unit 152 electrically connected to the second scan line 132 can be used to emit light, or can test the electrical characteristics of a thin film transistor (TFT) included in the pixel unit 152 by applying an electrical signal to the second scan line 132. In this regard, the pixel unit 152 electrically connected to the second scan line 132 is located in the display unit 120. Therefore, the pixel unit 152 shares the same, similar, or corresponding environment and structure as the pixel units 151 located in the display unit 120. Accordingly, the characteristics of the pixel unit 152 to test pixels are identical, similar, or correspond to the characteristics of the pixel units 151 in the display unit 120.

The pixel unit 152, as a pixel unit, electrically connected to the second scan line 132, typically cannot be used to display an image in the display unit 120, but the pixel unit 152 typically does not affect the image quality, since the pixel unit 152 is typically located in a corner 122 of the display unit 120. The pixel unit 152 electrically connected to the second scan line 132 denotes a location where a pixel can be formed. Thus, a light-emitting display device or element, or an electronic device such as a thin film transistor (TFT) that controls the light-emitting display device, can be formed in the pixel unit 152. In the latter case, according to aspects of the invention, the pixel unit 152 can be used to test the characteristics of the electronic device.

FIG. 4 is a plan view of the organic light emitting display device 101 according to another embodiment of the invention. Referring to FIG. 4, a display unit 120' includes a plurality of scan lines 131', a plurality of first data lines 141' and at least one second data line 142' separated from the first data lines 141'. A plurality of pixel units 151 are electrically connected to the scan lines 131' and the first data lines 141'. At least one pixel unit 152, as a pixel unit, located at least in a corner 122', or other suitable area, such as a peripheral area 121' which includes the corners 122', of the display unit 120', that is not connected to the first data lines 141', is electrically connected to the second data line 142' and to a scan line 131'.

In the organic light emitting display device 101, the pixel unit 152 located in a lower right corner 122' of the display unit 120' and electrically connected to the second data line 142' is a pixel unit. Therefore, the pixel unit 152 electrically connected to the second data line 142' can be used to emit light, or can test the electrical characteristics of a thin film transistor (TFT) included in the pixel unit 152 by applying an electrical signal to the second data line 142'. In this regard, the pixel unit 152 electrically connected to the second data line 142' is located in the display unit 120'. Therefore, the pixel unit 152 shares the same, similar, or corresponding environment and structure as the pixel units 151 located in the display unit 120'. Accordingly, the characteristics of the pixel unit 152 to test pixels are identical, similar, or correspond to the characteristics of the pixel units 151 in the display unit 120'.

The pixel unit 152 electrically connected to the second data line 142' typically cannot be used to display an image in the display unit 120', but the pixel unit 152 typically does not affect the image quality, since the pixel unit 152 is typically located in a corner 122' of the display unit 120'. The pixel unit 152 which is electrically connected to the second data line 142' denotes a location where a pixel can be formed. Thus, a light-emitting display device or element, or an electronic device such as a thin film transistor (TFT) that controls the light-emitting display device, can be formed in the pixel unit 152. In the latter case, according to aspects of the invention, the pixel unit 152 can be used to test the characteristics of the electronic device.

FIG. 5 is a plan view of the organic light emitting display device 102 according to another embodiment of the invention. Referring to FIG. 5, a plurality of first scan lines 131" and a plurality of first data lines 141" crossing the first scan lines 131" are included in a display unit 120" on a substrate 110. Also, at least one second scan line 132", separated from the first scan lines 131", and at least one second data line 142", separated from the first data lines 141", are included in the display unit 120". A plurality of pixel units 151 are electrically connected to the first scan lines 131" and the first data lines 141". At least one pixel unit 152, as a pixel unit, typically located at least in a corner 122", or other suitable area, such as a peripheral area 121" which includes the corners 122" of the display unit 120", that is not connected to the first scan lines 131" and the first data lines 141" is electrically connected to the second scan line 132" and the second data line 142".

In the organic light emitting display device 102, the pixel unit 152 that is typically located in a corner 122" of the display unit 120" and electrically connected to the second scan line 132" and the second data line 142" is a pixel unit for testing pixels. Therefore, the pixel unit 152 electrically connected to the second data line 142" can be used to emit light or can test the electrical characteristics of a thin film transistor (TFT) included in the pixel unit 152 by applying an electrical signal to the second scan line 132" and the second data line 142". In this regard, the pixel unit 152, electrically connected to the second scan line 132" and the second data line 142", is located in the display unit 120". Therefore, the pixel unit 152 shares the same, similar, or corresponding environment and structure as the pixel units 151 located in the display unit 120". Accordingly, the characteristics of the pixel unit 152 to test pixels are identical, similar or correspond to the characteristics of the pixel units 151 in the display unit 120".

The pixel unit 152 electrically connected to the second scan line 132" and the second data line 142" typically cannot be used for displaying an image in the display unit 120", but the pixel unit 152 typically does not affect the image quality since the pixel unit 152 is typically located in a corner 122" of the display unit 120". The pixel unit 152 electrically connected to the second scan line 132" and the second data line 142" denotes a location where a pixel can be formed. Thus, a light-emitting display device or element, or an electronic device such as a thin film transistor (TFT) that controls the light-emitting display device, can be formed in the pixel unit 152. In the latter case, the pixel unit 152 can be used for testing the characteristics of the electronic device.

An organic light emitting display device according to aspects of the invention can have the following effects or characteristics, for example. First, at least one pixel unit to test pixels, having the same, similar, or corresponding characteristics and structure as pixel units that display images can be formed. Second, the pixel unit to test pixels is located in a display unit so that the pixel unit shares the same, similar, or corresponding environment and structure as the pixel units to display images in the display unit. Therefore, a suitable characteristic test of the pixels in a display device can be made according to aspects of the invention. Also, according to aspects of the invention, the at least one pixel unit to test the pixels is typically located in a corner, or other suitable area, such as a peripheral area which includes the corners, of the display unit, so that the pixel unit, as a pixel unit, typically cannot affect the quality of a displayed image.

The foregoing embodiments, aspects and advantages are merely exemplary and are not to be construed as limiting the invention. Also, the description of the embodiments of the invention is intended to be illustrative, and not to limit the scope of the claims, and various other alternatives, modifications, and variations will be apparent to those skilled in the art. Therefore, although a few embodiments of the invention have been shown and described, it would be appreciated by those skilled in the art that changes may be made in the embodiments without departing from the principles and spirit of the invention, the scope of which is defined in the claims and their equivalents.

What is claimed is:

1. An organic light-emitting display device, comprising:

a substrate;

a display unit on the substrate, the display unit having a display area to display images, the display area including a plurality of pixels, and the plurality of pixels including a plurality of first pixel units and a second pixel unit, the second pixel unit being in a corner of the display area;

a plurality of data lines, the plurality of data lines including a first data line connected to the second pixel unit and to one first pixel unit of the plurality of first pixel units, the one first pixel unit being adjacent to and in a same column as the second pixel unit; and a plurality of scan lines, the plurality of scan lines including first scan lines and a second scan line;

the first scan lines in the display area of the display unit being connected to other first pixel units of the plurality of first pixel units, some of the other first pixel units being in a same row as the second pixel unit and being separated from the first data line, the second scan line in the display area of the display unit being connected to the second pixel unit, the second scan line being separated from the first scan lines, and the second scan line extending beyond the display area, the plurality of first pixel units being arranged to display the images, and the second pixel unit being in a non-connected relationship with the plurality of first scan lines and the second pixel unit being arranged not to display the images but to test the plurality of first pixel units displaying the images.

2. The organic light-emitting display device of claim 1, wherein:

the second pixel unit electrically connected to the second scan line comprises electronic elements.

3. The organic light-emitting display device of claim 2, wherein:

the electronic elements comprise thin film transistors (TFTs).

4. The organic light-emitting display device of claim 1, wherein:

the second pixel unit has characteristics corresponding to characteristics of the plurality of first pixel units.

5. An organic light-emitting display device, comprising:

a substrate;

a display unit on the substrate, the display unit having a display area to display images, the display area including a plurality of pixels, and the plurality of pixels including a plurality of first pixel units and a second pixel unit, the second pixel unit being in a corner of the display area;

a plurality of scan lines, the plurality of scan lines including a first scan line connected to the second pixel unit and to one first pixel unit of the plurality of first pixel units, the one first pixel unit being adjacent to and in a same row as the second pixel unit; and a plurality of data lines, the plurality of data lines including first data lines and a second data line;

the first data lines in the display area of the display unit being connected to other first pixel units of the plurality of first pixel units, some of the other first pixel units being in a same column as the second pixel unit and being separated from the first scan line, the second data line in the display area of the display unit being connected to the second pixel unit, the second data line being separated from the first data lines, and the second data line extends beyond the display area, the plurality of first pixel units being arranged to display the images, and the second pixel unit being in a non-connected relationship with the plurality of first data lines, and the second pixel unit being arranged not to display the images but to test the plurality of first pixel units displaying the images.

6. The organic light-emitting display device of claim 5, wherein:

the second pixel unit electrically connected to the second data line comprises electronic elements.

7. The organic light-emitting display device of claim 6, wherein:

the electronic elements comprise thin film transistors (TFTs).

8. The organic light-emitting display device of claim 5, wherein:

the second pixel unit has characteristics corresponding to characteristics of the plurality of first pixel units.

* * * * *